United States Patent [19]

Pagano et al.

[11] Patent Number: 4,961,673

[45] Date of Patent: Oct. 9, 1990

[54] RETAINING WALL CONSTRUCTION AND METHOD FOR CONSTRUCTION OF SUCH A RETAINING WALL

[75] Inventors: Michael A. Pagano, Marietta, Ga.; Longine J. Wojciechowski, Potomac, Md.

[73] Assignee: The Reinforced Earth Company, Arlington, Va.

[21] Appl. No.: 311,147

[22] Filed: Feb. 14, 1989

Related U.S. Application Data

[63] Continuation-in-part of Ser. No. 126,276, Nov. 30, 1987, abandoned.

[51] Int. Cl.[5] ..... E02D 29/02

[52] U.S. Cl. ..... 405/287; 405/284; 405/262; 405/258; 403/209; 403/43

[58] Field of Search ..... 405/258, 262, 284, 285, 405/286, 287; 403/209, 213, 398, 43, 44, 45, 46, 47, 48

[56] References Cited

U.S. PATENT DOCUMENTS

| | | | |
|---|---|---|---|
| 2,456,149 | 12/1948 | Roesen | 403/43 |
| 3,381,483 | 5/1968 | Huthsing | 405/285 X |
| 3,389,924 | 6/1968 | Bush et al. | 403/43 |
| 3,421,326 | 1/1969 | Vidal | 405/284 |
| 3,464,211 | 9/1969 | Andresen | 405/262 |
| 3,570,252 | 3/1971 | Vidal | 405/114 |
| 3,570,253 | 3/1971 | Vidal | 405/284 |
| 3,631,682 | 1/1972 | Hilfiker et al. | 405/273 |
| 3,686,873 | 8/1972 | Vidal | 405/262 |
| 3,922,864 | 12/1975 | Hilfiker | 405/262 |
| 3,981,038 | 9/1976 | Vidal | 405/284 X |
| 4,045,965 | 9/1977 | Vidal | 405/287 |
| 4,051,570 | 10/1977 | Hilfiker | 405/273 X |
| 4,067,166 | 1/1978 | Sheahan | 405/284 X |
| 4,068,482 | 1/1978 | Hilfiker | 405/272 |
| 4,081,219 | 5/1978 | Dykmans | 403/43 |
| 4,116,010 | 9/1978 | Vidal | 405/262 |
| 4,117,686 | 10/1978 | Hilfiker | 405/30 X |
| 4,154,554 | 5/1979 | Hilfiker | 405/273 |
| 4,260,296 | 4/1981 | Hilfiker | 405/284 |
| 4,266,890 | 5/1981 | Hilfiker | 405/286 |
| 4,324,508 | 4/1982 | Hilfiker et al. | 405/284 |
| 4,329,089 | 5/1982 | Hilfiker et al. | 405/262 |
| 4,341,491 | 7/1982 | Newmann | 405/258 |
| 4,343,572 | 8/1982 | Hilfiker | 405/287 X |
| 4,391,557 | 7/1983 | Hilfiker et al. | 405/287 |
| 4,426,176 | 1/1984 | Terada | 405/285 |
| 4,440,527 | 4/1984 | Vidal | 405/284 |
| 4,494,892 | 1/1985 | Wojciechowski | 404/6 |
| 4,499,698 | 2/1985 | Hoyt et al. | 405/258 X |
| 4,505,621 | 3/1985 | Hilfiker et al. | 405/284 |
| 4,537,388 | 8/1985 | McCabe | 403/43 X |
| 4,545,703 | 10/1985 | Boynton | 405/286 X |
| 4,557,634 | 12/1985 | Vidal | 405/286 |
| 4,564,967 | 1/1986 | Vidal | 405/287 X |
| 4,616,959 | 10/1986 | Hilfiker | 405/286 |
| 4,618,283 | 10/1986 | Hilfiker | 405/124 |
| 4,643,618 | 2/1987 | Hilfiker et al. | 405/286 |
| 4,653,962 | 3/1987 | McKittrick et al. | 405/286 |
| 4,655,646 | 4/1987 | Babcock et al. | 405/286 |
| 4,661,023 | 4/1987 | Hilfiker | 405/262 |
| 4,725,170 | 2/1988 | Davis | 405/286 |
| 4,756,645 | 7/1988 | Balzer | 405/284 |
| 4,824,293 | 4/1989 | Brown et al. | 405/262 X |

*Primary Examiner*—Dennis L. Taylor
*Assistant Examiner*—J. Russell McBee
*Attorney, Agent, or Firm*—Allegretti & Witcoff

[57] ABSTRACT

A retaining wall construction is comprised of a first portion which includes compacted granular fill defining a three dimensional earthenwork bulk form including a plurality of tensile members dispersed within that bulk form to enhance the coherency of the mass. The tensile members project from the bulk form and are connected to a second component portion which defines a face construction. The face construction is comprised of a plurality of facing panels connected to tensile members with concrete layers enveloping the connection between the facing panels and the tensile members.

29 Claims, 9 Drawing Sheets

RETAINING WALL CONSTRUCTION AND METHOD FOR CONSTRUCTION OF SUCH A RETAINING WALL

REFERENCE TO RELATED APPLICATION

This application is a continuation-in-part of a copending application Ser. No. 126,276 filed Nov. 30, 1987, which is hereby expressly abandoned.

BACKGROUND OF THE INVENTION

This invention relates to an improved retaining wall construction and more particularly to a retaining wall construction generally of the type first disclosed in a series of Vidal patents including U.S. Pat. No. 3,421,326, U.S. Pat. No. 3,686,873, U.S. Pat. No. 4,045,965 and U.S. Pat. No. 4,116,010.

Vidal teaches that longitudinal, tensile members may be positioned within a granular, compacted mass of earth to thereby enhance the coherency of the particles which form the mass. The mass can then serve as a wall or embankment. This phenomenon of enhanced coherency is accomplished, at least in part, by frictional engagement of the particles in the mass with the tensile members extending through the mass.

Vidal teaches further that a particularly effective construction utilizes longitudinal metal strips as the tensile members. These longitudinal metal strips are arranged in a geometric array within a bulk form of compacted earth. To complete the construction the ends of at least some of the tensile members are affixed to facing panels so as to define the exposed facing or wall of the construction.

This general construction has found much acceptance particularly in the road building industry wherein such constructions are used as retaining walls for embankments and as roadway supports. Other uses of this construction technique include coal and grain slots, sea walls, bridge abutments and the like.

Subsequent to the aforesaid generic developments by Vidal, various species have been patented. For example, Hilfiker in U.S. Pat. No. 4,117,686 discloses the use of wire gridforms as a substitute for the tensile members developed by Vidal. Hilfiker has patented various wall constructions using wire gridform members in combination with various facing constructions. Hilfiker U.S. Pat. No. 4,117,686 discloses a wire grid facing construction in combination with a coarse rock backfill. Another Hilfiker patent shows that the wire grid facing member and grid tensile member may comprise a continuous member, U.S. Pat. No. 4,505,621. Later Hilfiker patents disclose the addition of a cast in place wall to the wire grid facing to further define the facing construction, Hilfiker U.S. Pat. Nos. 4,329,089, 4,391,557 and 4,643,618. Alternatively, Hilfiker discloses a precast facing construction in association with the gridform tensile members, U.S. Pat. No. 4,324,508.

There has remained, however, a generally unresolved problem which other constructions do not appear to adequately address. Specifically, when constructing an earth retaining wall of the type described, the granular material, which is compacted for cooperation with the tensile members, may not fully consolidate to its final volume during the period of wall construction. For example, compacted earth may consolidate approximately 90% of its expected bulk consolidation during the construction phase of such a retaining wall. Therefore, over time, the bulk form will continue to consolidate and as a result, this compacted mass of earth will impart straining forces on the planar front face of the bulk form. In the prior art constructions, the major portion of such strain was absorbed by the facing or wall construction generally associated with the bulk form embankment arrangement.

Where the facing or wall construction comprises a wire grid form, the distorting strain will not destroy the aesthetics of the facing construction. However, when a wire gridform facing construction is not desired, a solid facing construction, such as those suggested by the prior art, cannot accommodate such forces without adverse affect to their appearance.

Thus, there has remained a need for an improved construction for an earthen bulk form retaining wall construction and method for fabricating the same in which the reinforced earth bulk form can accommodate continued consolidation without affect to the facing or wall construction. The present invention comprises such an improved construction and method.

SUMMARY OF THE INVENTION

Briefly, the present invention comprises an improved retaining wall construction formed of two separate but connected component portions or parts. The first component portion is comprised of a compacted granular fill material which defines a three dimensional earthenwork bulk form having a generally planar front face. The earthenwork bulk form includes a plurality of tensile members dispersed within that bulk form for enhancement of the coherency of the mass of the bulk form. The tensile members, at least in part, frictionally engage the granular soil or fill material. These tensile members, or at least some of them, project through the front face or front wall of the bulk form. The front face or front wall of the bulk form is defined by a series of gridforms which are stacked one upon the other and attached to various tensile members. The gridforms thus, in the preferred embodiment, extend partially in the horizontal direction into the bulk form and also extend upwardly from a horizontal plane to define the front face of the bulk form.

The second principal component portion or part of the construction is the facing construction. It is comprised of a series of discrete panel members connected with one another to form a mosaic front wall of the facing. The back side of each panel member includes a reinforcing member which also projects into the region between the front face of the bulk form and the back side of each panel member. Within this region, connecting means are provided for connecting the tensile members with the reinforcing members projecting from the back side of the panels. The connection is not necessarily a rigid connection. Rather, it may be an overlapping mechanical linkage. Positioned within the region between the panels and the front face of the bulk form is an aggregate, preferably concrete. The concrete is preferably poured in layers and is thereby built up to the full height of the facing construction just as are the panels. The facing construction is thus comprised of preformed panels and the poured aggregate in combination with means for connecting the panels to the tensile members.

The facing construction is generally rigid and resistant to strain. The earthenwork bulk form, however, is capable of consolidation and thus change in shape and size thereby effecting strains on the tensile members as well as the gridforms particularly along the front face of the bulk form. The bulk form thus is capable of changing shape in a significant degree relative to the front facing. In summary, the front facing remains in a fixed consolidated form unaffected by the strains in the bulk form. In this manner, the facing portion of the wall construction maintains its integrity whereas the earthenwork, bulk form maintains its integrity as a result of continued consolidation thereof with time.

Thus, it is an object of the invention to provide an improved retaining wall construction comprised of an earthenwork bulk form capable of consolidation and a facing portion which is not susceptible to consolidation.

Yet a further object of the invention is to provide a retaining wall construction wherein a wall portion of the construction remains connected with a consolidatable earthenwork bulk form portion of the construction despite the development of relatively significant strains in the bulk form with the passage of time.

Yet a further object of the invention is to provide a retaining wall construction which is easy and simple to erect and which incorporates techniques for the fabrication of retaining walls utilizing tensile members to distribute stress in a coherent, earthen, bulk form.

Yet another object of the invention is to provide an inexpensive and easily erectable, improved retaining wall construction.

Yet a further object of the invention is to provide a retaining wall construction and a method for manufacture thereof which is straightforward and does not require significant special component parts or equipment for the erection thereof.

These and other objects, advantages and features of the invention will be set forth in the detailed description which follows.

BRIEF DESCRIPTION OF THE DRAWING

In the detailed description which follows, reference will be made to the drawing comprised of the following figures.

DESCRIPTION OF THE PREFERRED EMBODIMENT

Figure 1:
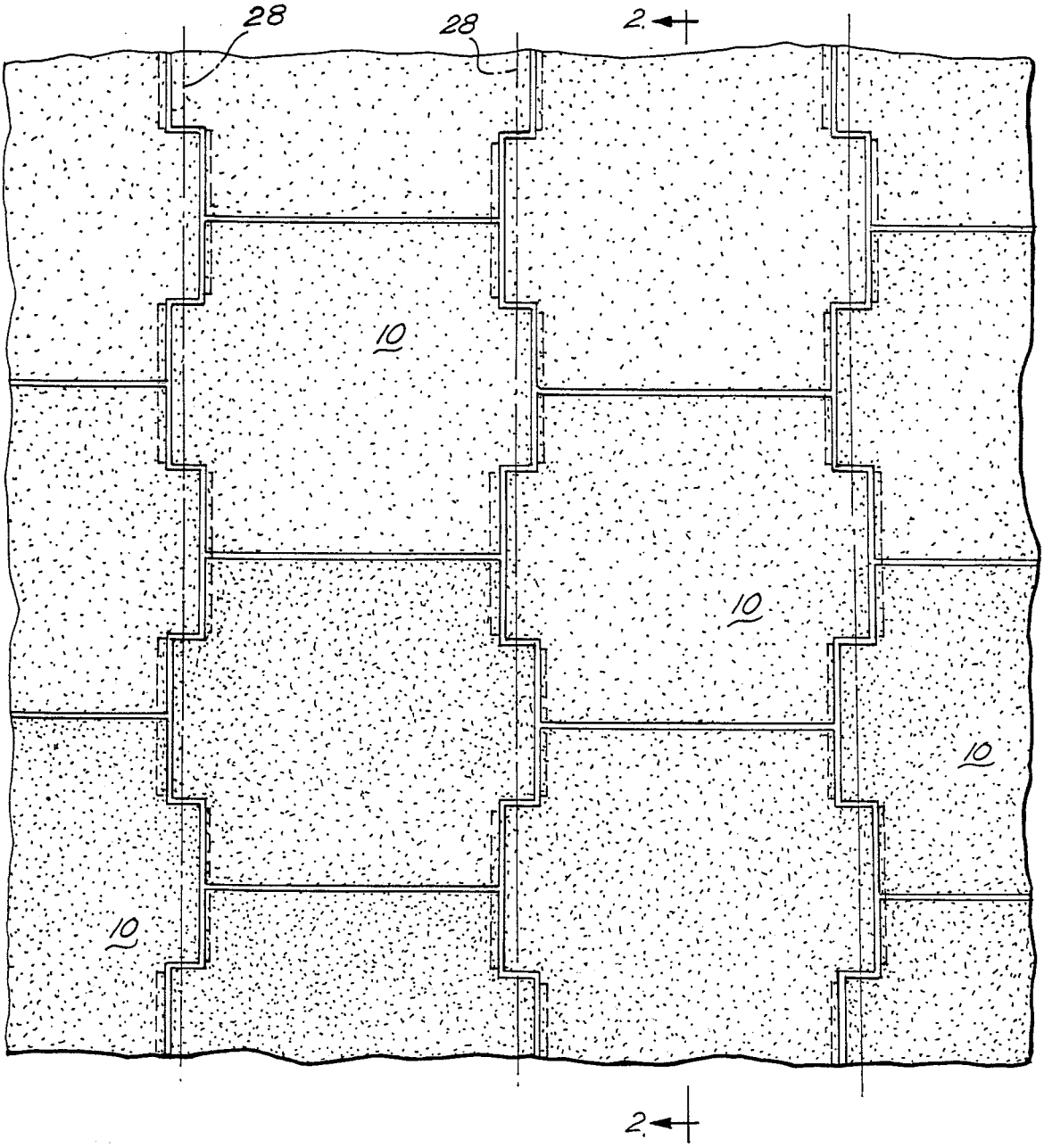
FIG. 1 is a front plane view of a typical completed wall incorporating the present invention and made in accordance with the method of the present invention.

The wall construction of the present invention can best be illustrated by describing the method of construction of the wall with reference to the drawing FIGS. 1–20. Like numbers thus designate like parts in the respective drawings.

Referring first to FIG. 1, there is illustrated the configuration and appearance of the outside facing or outside wall surface of the construction. The outside facing is comprised of a plurality of panels 10. The panels 10 are preferably precast concrete forms. Any one of a number of forms may be utilized including a cruciform shape as depicted in FIG. 1, a hexagonal form, a square form, or any of a number of other forms. Moreover, the facing may be of other preform materials, such as steel preforms, wood preforms and the like. Vidal, in his various previously cited patents, discloses many such preforms. Those descriptions are incorporated herewith by reference and identified as among the preforms which are useful in the practice of the present invention.

Figure 2:
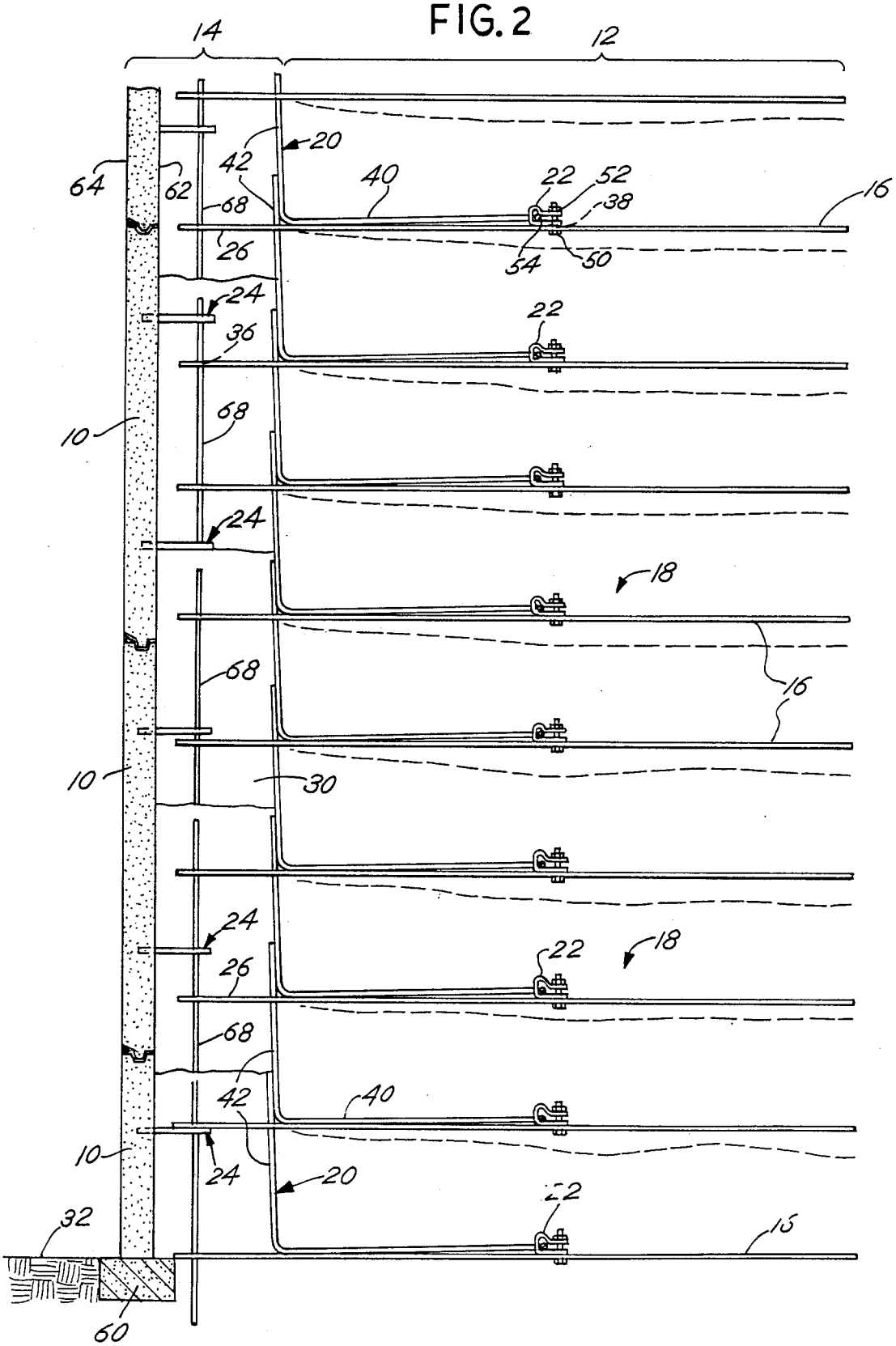
FIG. 2 is a side cross sectional view of FIG. 1 taken along line 2—2 before the earthen, bulk form portion of the wall is fully consolidated.

Referring now to FIG. 2, there is illustrated a cross section of the construction of the present invention immediately subsequent to completion of erection of the construction. The various parts of the construction can be generally categorized into two main components. The first main component is generically referred to as the earthen bulk form 12. The second major component is referred to as the facing construction 14.

The bulk form 12 is generally comprised of four component parts:

(1) elongated tensile strips or members 16, (2) granular back fill 18, (3) gridforms 20 having an L-shaped cross section, and (4) attachment clips 22.

The separate parts will be described in greater detail below.

Figure 17:
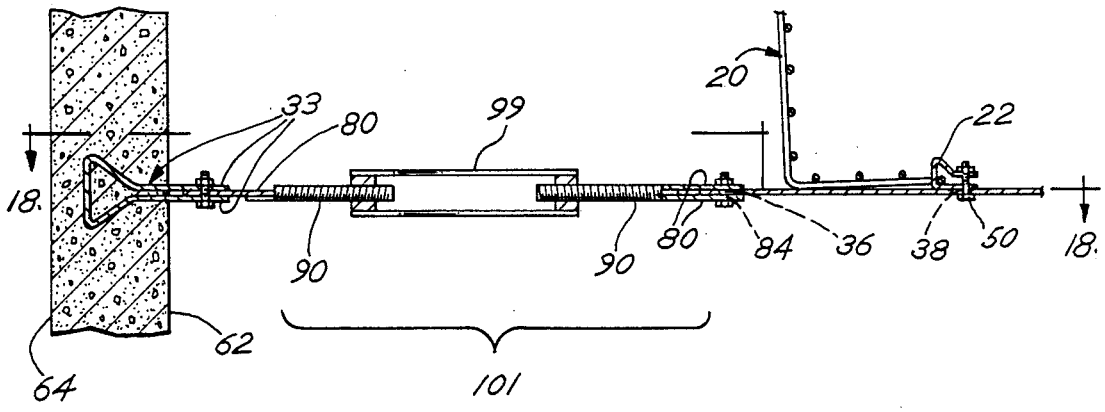
FIG. 17 is a side plane view of the facing construction illustrating a preferred facing construction arrangements.
Figure 18:
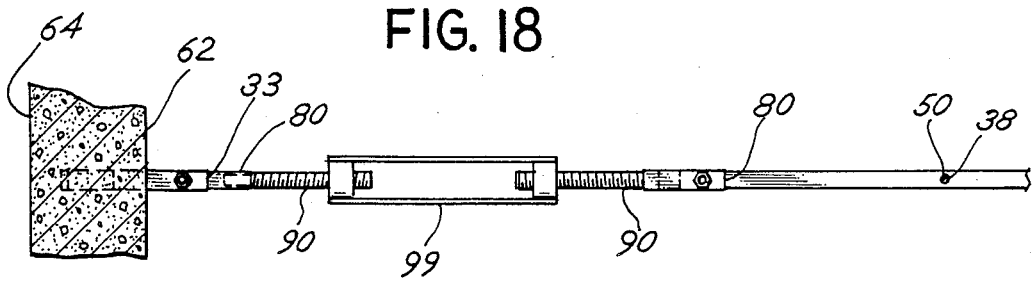
FIG. 18 is a top plane view of FIG. 17.

The facing construction 14 is comprised of the following parts:

(1) front, preform panels 10, (2) reinforcing members 24 projecting from the front panels 10, (3) tensile member extensions 26, (4) connecting member 68; or alternatively 101, FIG. 17.

(5) generally parallel layers of concrete 30.

Again, this assembly of parts will be discussed in greater detail below.

The Earthen Bulk Form

Figure 4:
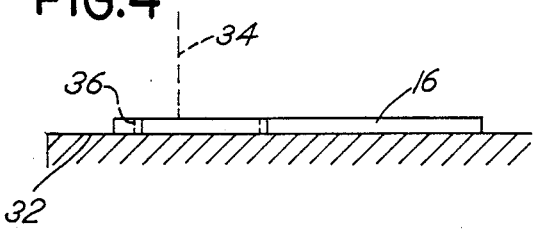
FIG. 4 is a side plane view of the first step in the fabrication of the wall of FIG. 1.
Figure 5:
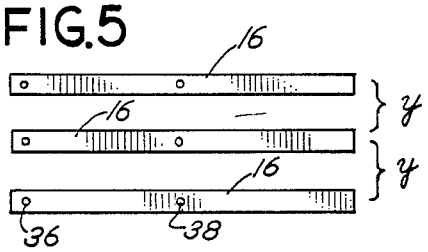
FIG. 5 is a top plane view of the step of FIG. 4.

The earthen bulk form 12 can best be described by referring to the steps in the construction of this bulk form 12. The bulk form 12 is initially built, at least in part, before building the facing construction 14. Referring therefore to FIGS. 4 and 5, the first step in the building of the bulk form 12 is to prepare a base 32 upon which the earthen bulk form 12 will be constructed. This is done in accord with known civil engineering practice. The base 32 in FIG. 4 defines a datum or plane on which the construction of the bulk form 12 will commence. Often the base or datum 32 will be an excavated surface sometimes with a layer of compacted gravel or fill thereon.

In a preferred embodiment of the invention, a series of elongated tensile member strips 16 are next positioned in geometric array on the plane 32. The size of the strips 16, their composition, shape, form and the arrangement of the geometrical array are in accord with civil engineering practices now considered to be of ordinary skill in the art. Of course, the use of strips 16 as shown in FIG. 4 and 5 is the preferred embodiment of the invention. Nonetheless, numerous alternatives to strips 16 may be utilized including fabric, metal grids, mesh, rods, and the like. Importantly, compacted soil will coact with the chosen tensile members 16, at least in part by means of frictional engagement, to thereby distribute stresses throughout the bulk form 12 and thus enhance the coherency of the bulk form 12 as contrasted with a bulk form 12 not having any such tensile members 16. It is further understood that strips 16 as depicted in FIG. 4 may be of the type disclosed in Vidal U.S. Pat. No. 3,686,873. Nonetheless, gridforms and other materials or members which do not rely exclusively on frictional interaction between the compacted fill or earth and the member are useful in the practice of the invention and are considered to be within the scope of the invention. Further, anchors alone or in combination with strips 16, rods or other members may be used within the bulk form 12.

Importantly, the strips 16 depicted in FIG. 4 as well as FIG. 5 are shown as extending forward beyond a predefined line 34 of a front face of the bulk form 12. Thus, the front face or front of form 12 is denoted by the phantom line 34 in FIG. 4. Some or all of the tensile members 16 may extend forward of the front face line 34. At least some of the tensile members 16 should extend forward of the phantom line 34 as well as longitudinally into the bulk form 12 generally transverse to the plane defined by the line 34. Nevertheless, it is still possible to have tensile members 16 extend at angles and with various orientations into the bulk form 12 while still being within the scope and still practicing the subject matter of the invention.

In the embodiment shown, the tensile members are strips 16 arranged in a common horizontal plane spaced uniformly from one another as depicted in FIG. 5. The strips 16 include an opening or passage 36 at their forward end and a second opening or passage 38 somewhere within the interior of the bulk form 12.

Figure 6:
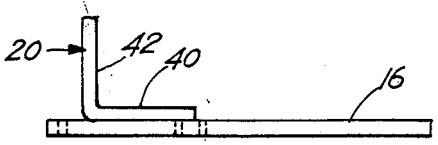
FIG. 6 is a side plane view of the next sequential step in the construction of the wall.
Figure 7:
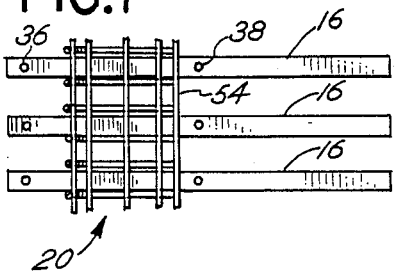
FIG. 7 is a top plane view of the step of FIG. 6.

As a next step in the formation of the bulk form 12, the gridforms 20 as shown in FIG. 6 are positioned on the tensile members 16. The gridforms 20 are preferably a wire mesh or grid of reinforcing bars. In other words, the gridforms 20 are a screen-type material in the preferred embodiment having a first horizontal run 40 and a second generally vertical and connected run 42. In the embodiment shown, the runs 40 and 42 have a generally L-shaped cross section as depicted in FIG. 6. The dimensions of the runs 40 and 42 as well as the lateral dimension of the gridform 20 may be varied in accordance with fill materials, spacing of tensile members 16 and other civil engineering factors. The gridform 20, however, does have a lateral dimension as depicted in FIG. 7 so that it overlays a series or plurality of the tensile members 16.

Again, the material which is utilized to form the gridform 20 may be varied. It may, for example, be a plastic material. It may be a wire material. In general, it is preferred that the material be flexible but retain a desired configuration as depicted in FIGS. 6 and 7.

Figure 8:
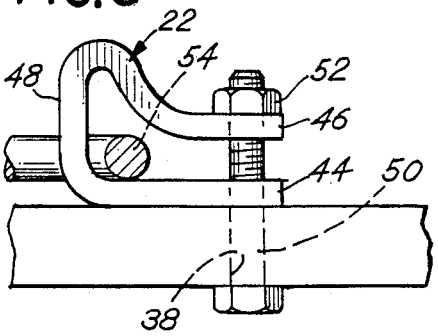
FIG. 8 is an enlarged side view of a connection between component parts of the construction of the invention and illustrates the next sequential step.
Figure 9:
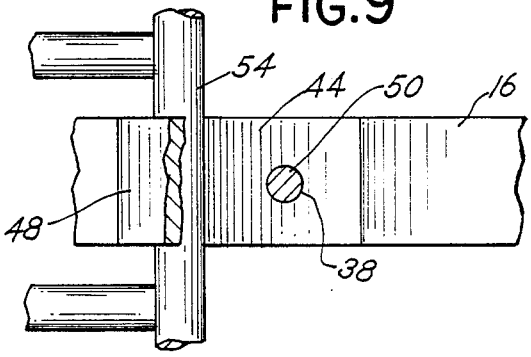
FIG. 9 is a cutaway top plane view of the step of FIG. 8.

As the next step in the practice of the invention, the gridforms 20 are attached to the tensile members 16. This is accomplished by means of attachment clips 22 as depicted in FIG. 8. Each attachment clip is comprised of a first leg 44, a second leg 46 and a connecting crown 48. Openings or passages are defined in the ends of the legs 44 and 46 for receipt of a bolt 50 that cooperates with a nut 52. The bolt 50 also fits through the passage 38 in the tensile member 16 and the associated openings in the legs 44 and 46. Prior to attachment of the bolt 50 to the clip 22, the clip 22 is fitted over a bar defining part of the gridform 20. Thus, a bar 54 in FIG. 8 is positioned between the legs 44 and 46 to be retained against the connecting crown 48. The bolt 50 and nut 52 then fasten the entire assembly to the tensile member or strip 16. In this manner the gridforms 20 are attached to the strips 16.

A series of clips 22 are utilized to attach a series of gridforms 20 to a series of tensile members 16 along the layer defining the datum plane 32 and thus along the entire extent of a line defining the front face of the bulk form 12.

Figure 10:
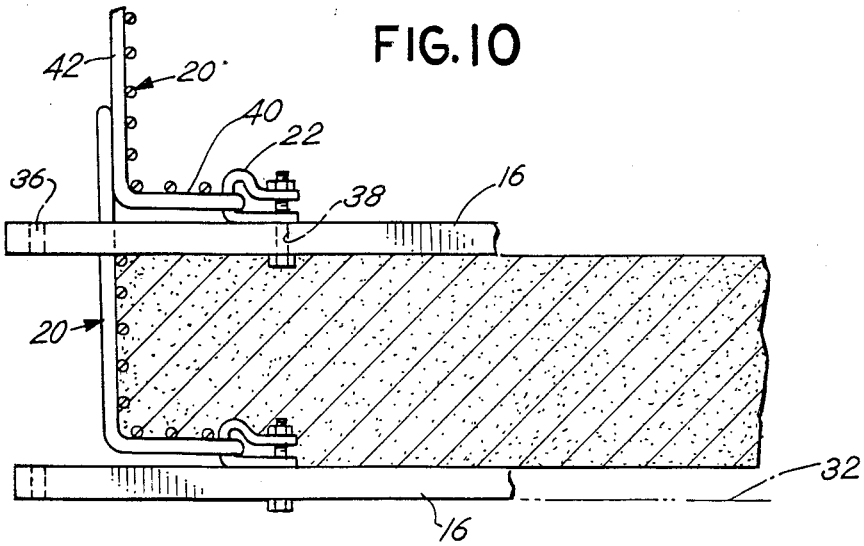
FIG. 10 is a side plane view of the next sequential step in the construction of the wall.

As the next step, illustrated in part by FIG. 10, a layer of compactable fill is positioned over the strips 16. Preferably the fill is compacted as it is placed in position on the strips 16. The fill is generally maintained within the volume of the bulk form 12 by the second run 42. The fill is provided to a level again determined by civil engineering principles. Then a second layer of tensile members 16 is introduced or positioned on top of the newly formed generally horizontal plane of the compacted fill as illustrated in FIG. 10. Gridforms 20 are then attached by clips 22 to the new layer of tensile members 16. Importantly the tensile members 16, or at least some of them, project forwardly through the second run 42.

Note also that the second run 42 of the first course or layer of gridforms 20 may extend beyond the tensile member defining the next layer in such a manner that the second run 42 is outwardly adjacent or alternatively, inwardly adjacent to the second run of the next or adjacent layer. FIG. 10 illustrates an outwardly adjacent arrangement. The overlaying runs 42 may be fastened together to enhance the stability of the system. However, this is not a necessary requirement.

The fill, which is compacted in each layer, will be retained, in part, by the second runs 42 so that ultimately by following the described procedure, a generally planar front face for the bulk form will be defined.

FIG. 2 illustrates a multiplicity of layers built in the manner described with respect to FIGS. 4–10. In this manner, a bulk form 12 is built utilizing the principles of enhancement of coherency of the granular back fill material by incorporating tensile members 16. Importantly, the tensile members 16, at least in part, project forwardly of the front face defined by the second runs 42. The tensile members thus, at least in part, extend beyond the region of the bulk form 12 into a region forward thereof.

The Facing Construction

Figure 11:
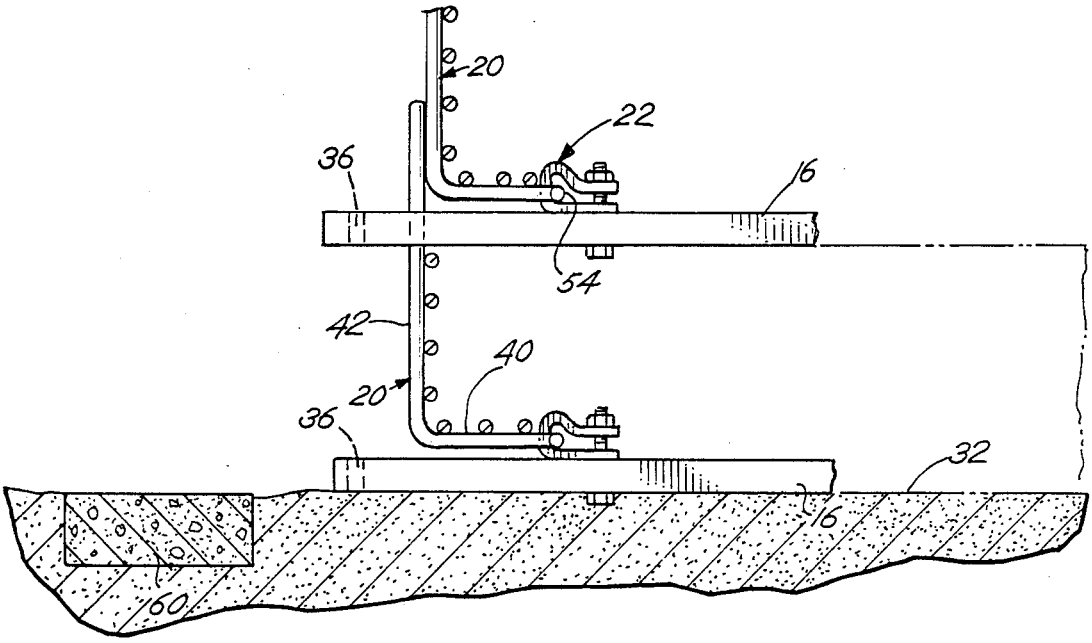
FIG. 11 is a further side plane view of the next sequential step in the construction.

As the next step in the construction of the wall of the invention, it is preferred that a footing be established coincident with the datum plane 32. FIG. 11 illustrates the placement of such a footing 60 forward of the bulk form 12. Footing 60 in FIG. 11 is preferably made from a concrete material and may be reinforced. Again, civil engineering principles are utilized in the design of the footing 60. The primary purpose of the footing 60 is to support the panels 10 and thus the weight of those panels 10 is determinative of the design of the footing 60.

Figure 12:
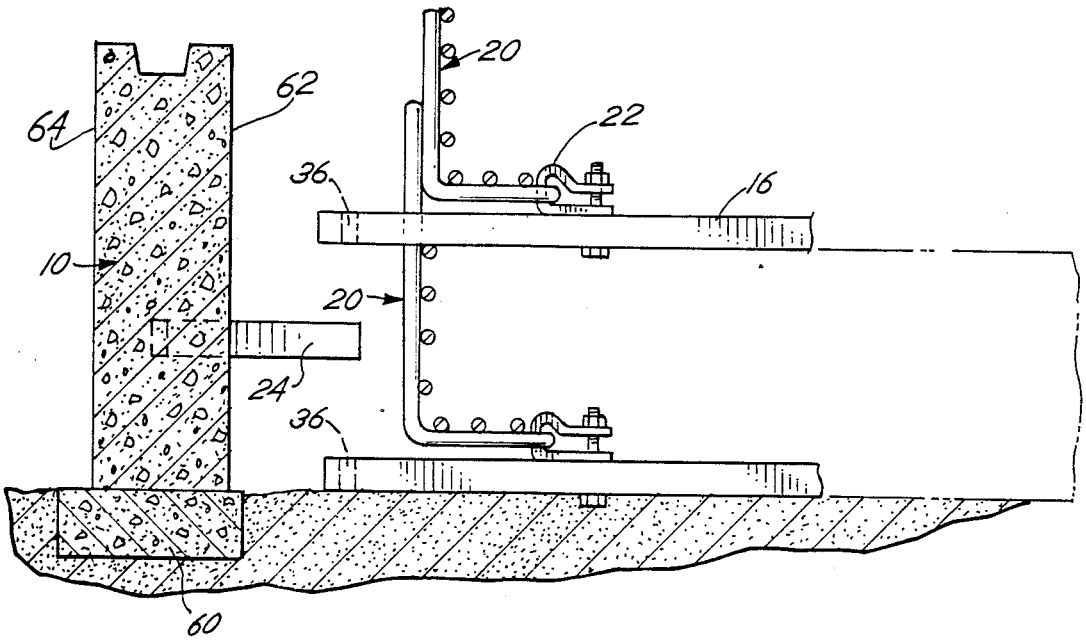
FIG. 12 is a side plane view of the subsequent step in the construction of one of the facing construction arrangements disclosed.

Next, as illustrated in FIG. 12, a first row of panels 10 are positioned on the footing 60. The panels 10, as previously described, may have any desired shape depending upon the engineering design for the project. In a preferred embodiment, the panels 10 are each made from a reinforced concrete preform and include a back face 62 and a front face 64. Projecting out from the back face 64 are reinforcing members 24.

Figure 19:
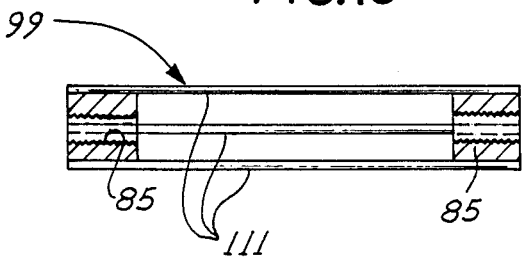
FIG. 19 is a side plane view of the main body portion of the connector; and, FIG. 20 is a side plane view of the connecting element between the panels and the retained bulk form.
Figure 20:
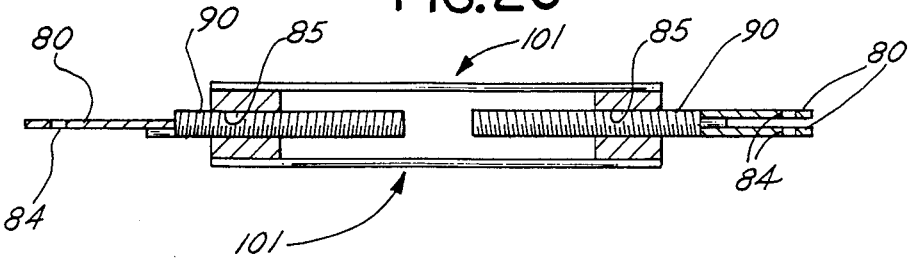

In one preferred embodiment, an adjustable connector 101 as illustrated in FIG. 17 is employed to provide a means for attaching the panels 10 to the extended tensile members 16. The advantage of the connector 101 is that it may be easily adjusted, at the time of construction, to a proper dimension for attaching the panels 10 to the extended tensile strips 16. Said connector consisting of a main body portion 99 and, inner and outer tubular extension members 90. Said main body 99 comprising two tubular end sections 85 connected by at least one attachment member, preferably four separate wire attachment members 111 as illustrated in FIG. 19. Said tubular end sections 85 contain internal threads. Likewise, said tubular extension members 90 are also threaded so as to mate with the threaded end sections 85 of the main body. The attachment between the threaded main body sections and the tubular extension members serving to permit the continued adjustment of the length of each extension member extending beyond the main body portion, and thereby allowing for the adjustment of the overall connector's length 101 in accordance with the distance between the back face 62 and the extended tensile trips 16 generally in the manner of operation of a turn buckle.

In this preferred embodiment, mounting plates 80 are attached to the ends of both extension members 90 to complete the connecting arrangement 101, said mounting plates lying in a generally horizontal plane, transverse to phantom line 34 and having an opening or passage 84 through which a bolt like member may be inserted.

As the next step in the construction, the connecting arrangement 101 is set in place by attaching one mounting plate to a reinforcing member 33 extending from the back face 62 of the panels 10. The reinforcing member used in this embodiment is illustrated in FIG. 17, and is generally referred to as a tie strip 33. In a preferred embodiment, this attachment is achieved by threading a bolt through the opening in both the tie strip and the mounting plate 84 and securing the bolt arrangement with a nut. The other mounting plate is likewise attached to an extended tensile strip 16, such that a bolt is fed through the opening in the mounting plate 84 and the opening in the extended tensile strip 36, and secure in place by a nut. This construction is illustrated in FIG. 17.

Although a slab like mounting member is disclosed, it is understood that any other mounting arrangement employed to fasten the connector to the reinforcing member 33 and tensile member 16 is considered within the scope of the present invention.

Next, a cast colloidal mix such as concrete 70 is filled into the region between the face of the bulk form 12 and the back face 62 of panel 10. In the preferred embodiment, the concrete 70 defines a layer no higher than the height of an adjacent panel 10. Alternative fillings may be used in place of the concrete 70 though the concrete 70 is preferred. Thus, some other aggregate may be filled into the described region to enhance the connection between the panel 10 and the bulk form strips 16. Assuming that concrete 70 has been used, it can be seen that a reinforced concrete structure is created connecting the bulk form 12 to the facing construction 14.

Figure 15:
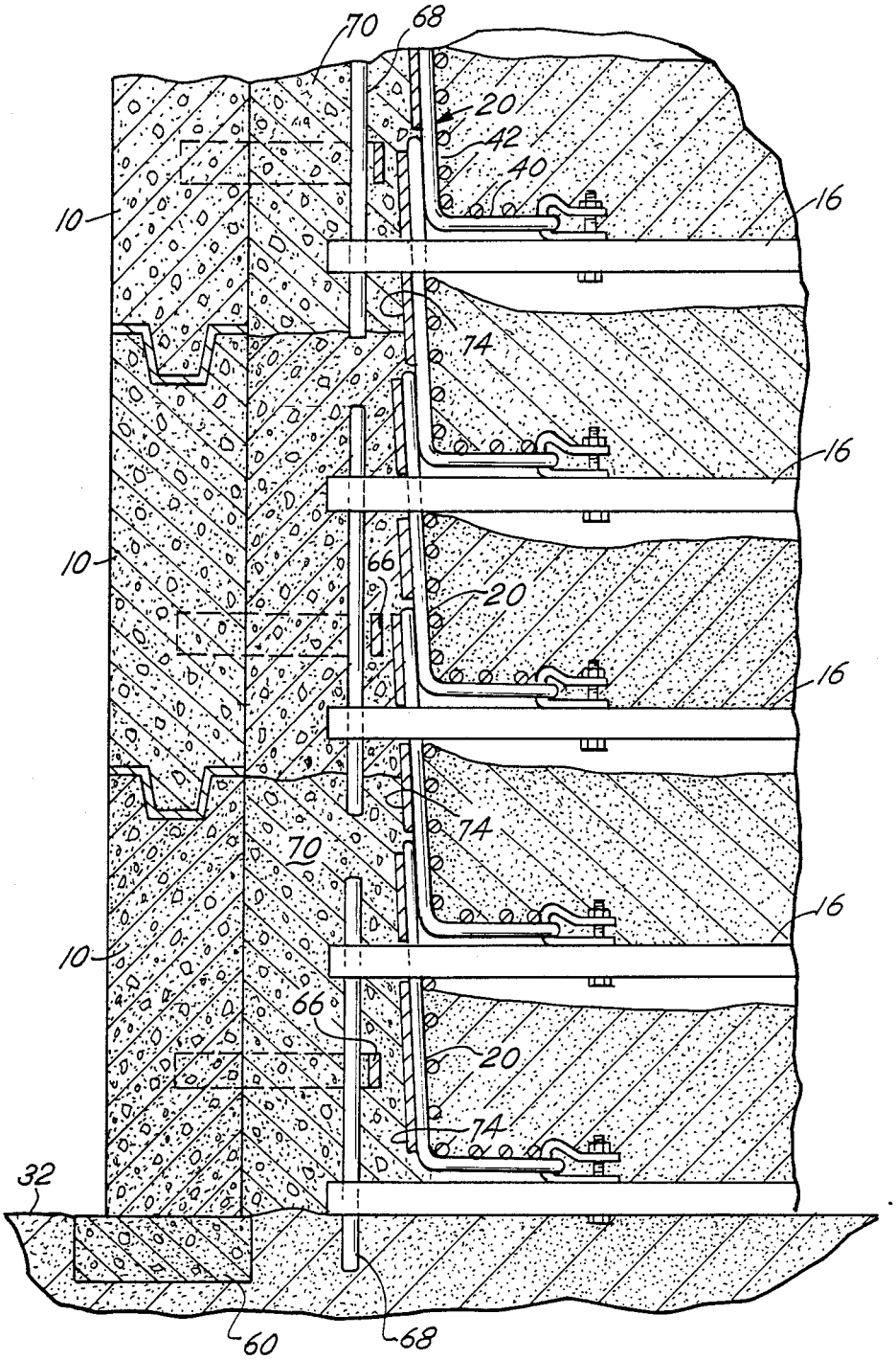
FIG. 15 shows the aggregation of steps in the construction of the wall.

As shown in FIG. 15, successive layers of panels 10 and aggregate layers 70 are built up to define the facing construction 14 of the wall. In the preferred embodiment, the bulk form 12 is initially constructed to its full height. Next the facing construction 14 is fabricated in the manner described on a layer by layer basis for the full height of the wall.

Figure 13:
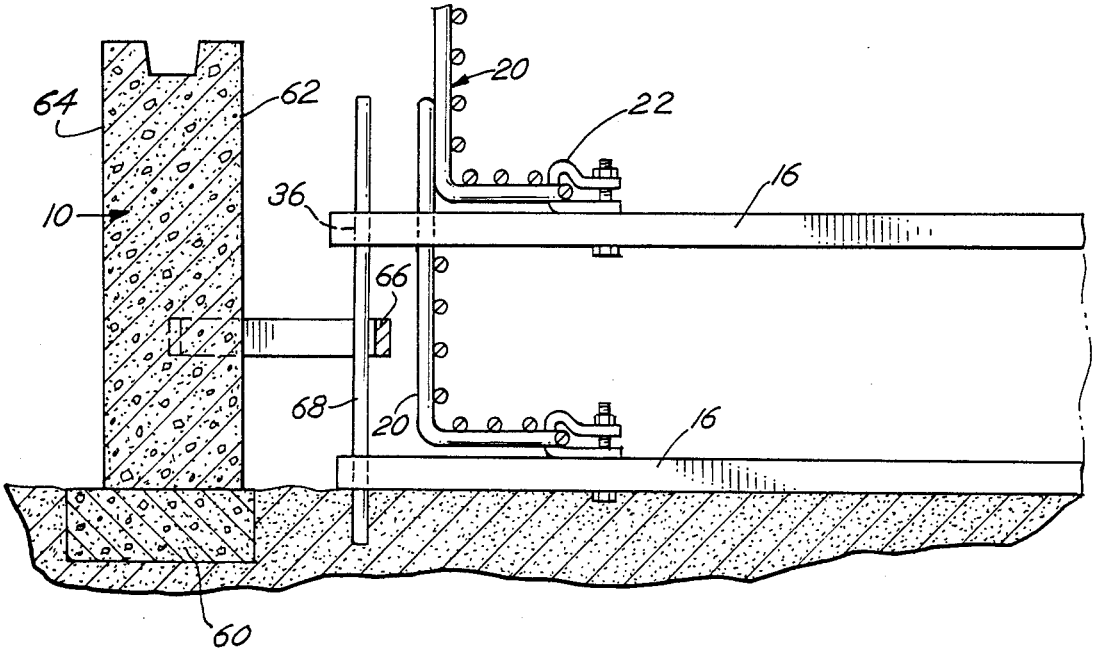
FIG. 13 represents the further sequential step in the construction of one of the facing constructions disclosed in a side plane view.
Figure 14:
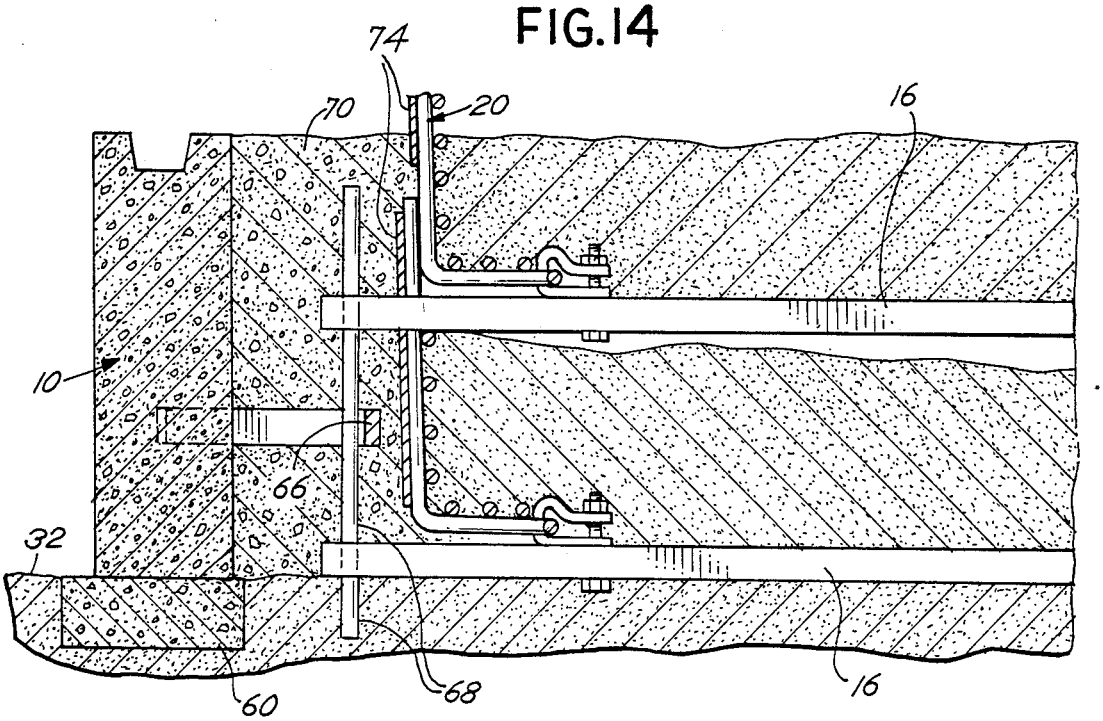
FIG. 14 is a plane side view of yet a further sequential step in the construction of one of the facing constructions.
Figure 16:
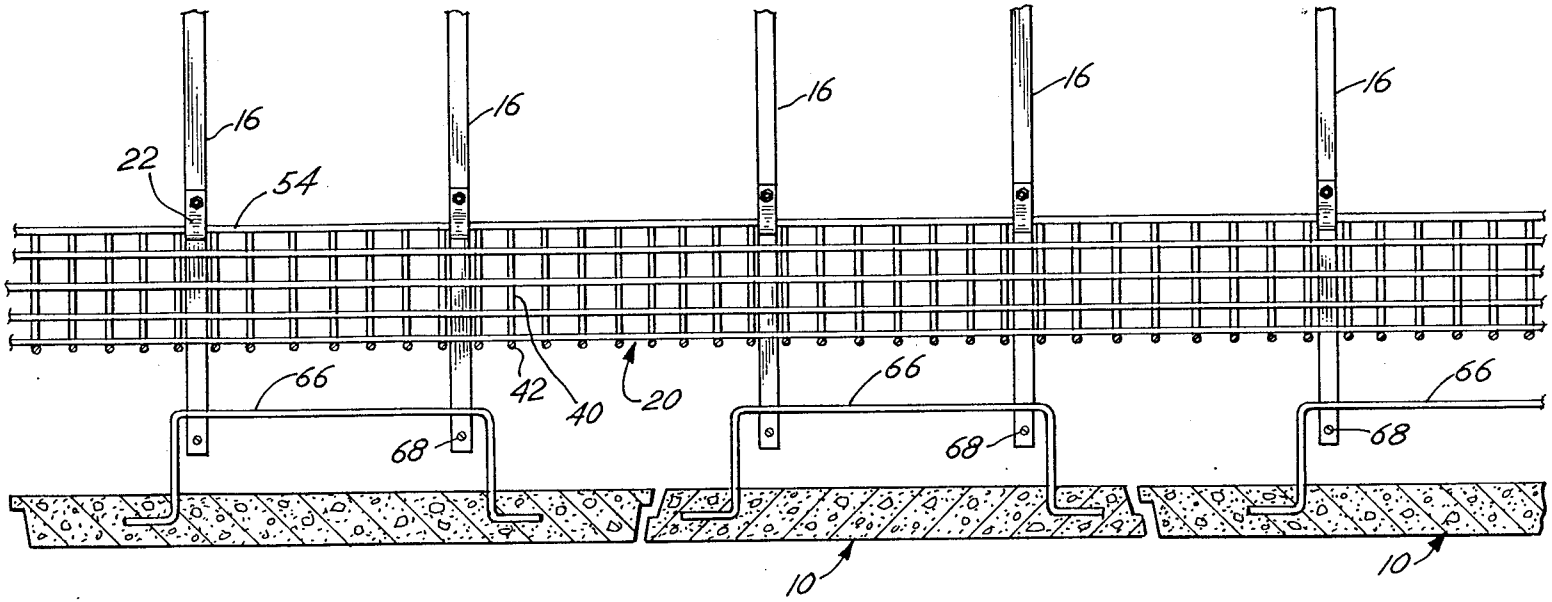
FIG. 16 is a top plane view, in section, of a wall construction according to one of the facing construction arrangements disclosed.

Alternatively, another embodiment of the invention would substitute the connector arrangement illustrated in FIGS. 13–16 for the connector arrangement illustrated in FIG. 17. Said connecting arrangement comprising a generally "U" shaped reinforcing member, as illustrated in FIG. 13 and 16. This reinforcing member being generally referred to as a reinforcing bar 66. Said reinforcing bars extend from the back face 62 of the panels 10 into the region such that, the reinforcing bar 66 extends or projects beyond a line between the openings 36 of the adjacent levels of tensile member as illustrated in FIG. 13. A vertical reinforcing bar or rod 68 is positioned through the opening 36 in the ends of the tensile members 16 and through loop 66 defined by the reinforcing bar projecting from the back face 62 of the panels 10, FIG. 13. The bar 68 projects downwardly into the soil and projects through at least two of the tensile strips 16. In this manner, a connection between the strips 16 and the panels 10 is effected.

It should be noted that an optional feature of the invention provides for placement of a fabric or other layer of flexible generally non-permeable material 74 along the outside face of the second runs 42 to thereby prevent the concrete or aggregate 70 from filling in around and engaging the gridform 20, FIG. 15.

Figure 3:
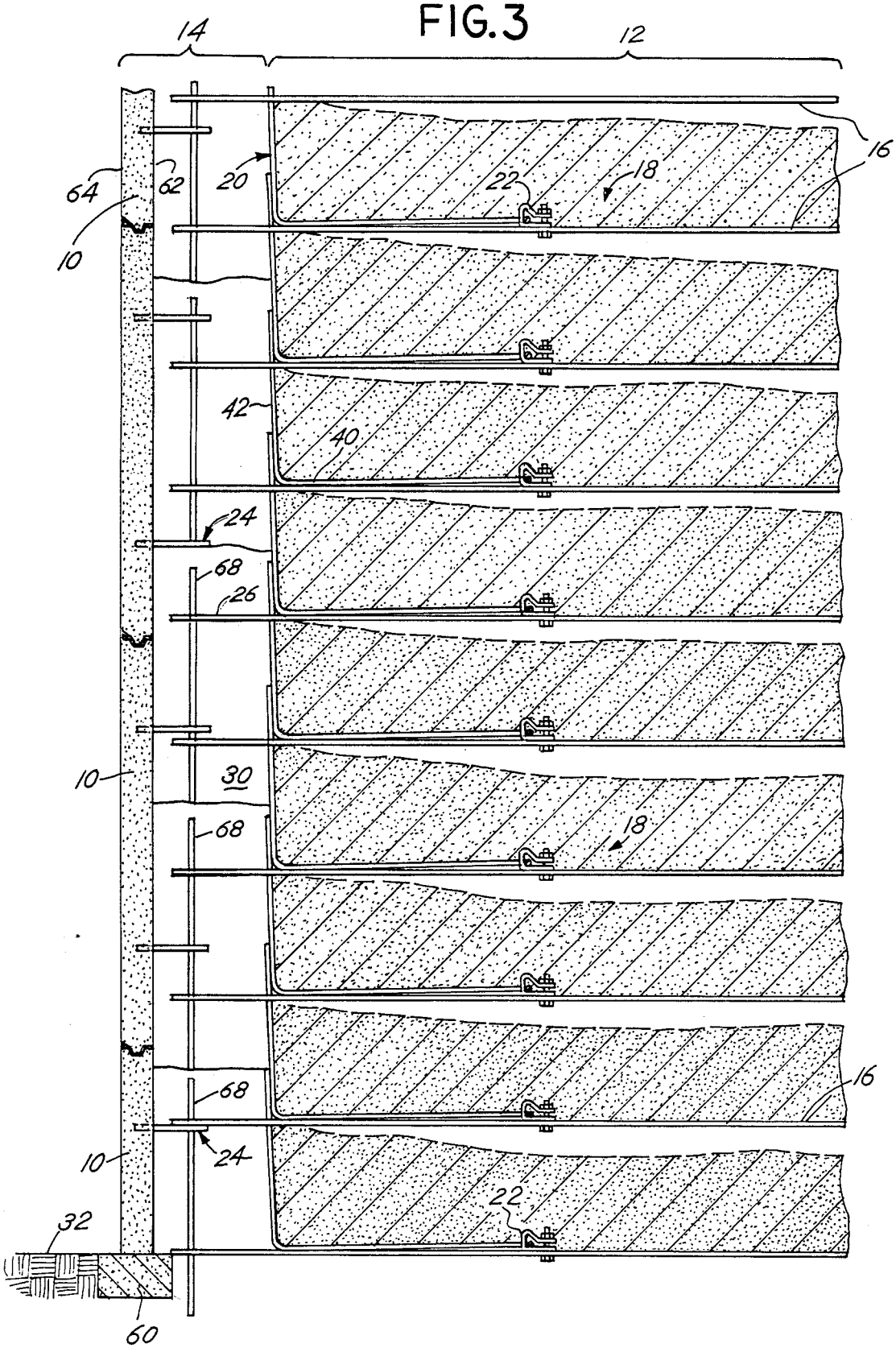
FIG. 3 is a side plane view similar to FIG. 2 wherein the earthen, bulk form portion of the wall has consolidated beyond the state of consolidation represented by FIG. 2.

Also, it can be seen then that the bulk form 12 and facing construction 14 when completed will be configured as in FIG. 2. However, if the granular fill comprising the bulk form 12 is not fully consolidated when the wall or retaining construction is initially completed, further settlement can be anticipated. This is represented by FIG. 3 wherein there has been further consolidation of the granular fill material. When this occurs, the strip members or tensile members 16 will tend to be strained or distort. Likewise, the gridforms 20 will tend to strain or distort. With the construction of the present invention, however, this strain or distortion will not be carried through to the facing construction 14 inasmuch as the strain will take place and will be localized in the gridforms 20 and strips 16 which are, relative to the facing construction 14, flexible. As a result, the bulk form 12 may consolidate without adversely impacting on the aesthetics and structural integrity of the facing construction 14.

While there has been set forth a preferred embodiment of the invention, it is to be understood that the invention is to be limited only by the following claims and their equivalents.

What is claimed is:

1. An improved retaining wall construction comprising, in combination:

(a) a granular, compactable fill defining a three dimensional earthenwork bulk form having a generally planar front face extending upwardly from a datum plane;

(b) said earthenwork bulk form including a plurality of tensile members dispersed within the bulk form and extending in a generally horizontal straight line array through the bulk form and projecting beyond the front face into a region forward of the front face, sets of said tensile members defining generally spaced horizontal planes of elevation through the bulk form, said tensile members at least in part frictionally engaging the fill;

(c) said earthenwork bulk form also including a plurality of gridforms, each gridform including a first run extending from the front face of the bulk form partially into the bulk form along a horizontal plane of elevation and connected to at least some of the tensile members at an elevation, each gridform also including a second run along the generally planar front face joined to the horizontal first run; said second run extending upwardly from the first run; said second runs of said gridforms forming a pattern of grid material defining the planar front face of the bulk form;

(d) a plurality of separate preformed panels defining a complete wall surface generally parallel to and spaced outwardly from the planar front face of the bulk form, to define the region, each of said panels including a front side and a back side, and reinforcing means integral with each panel and extending into the region, said panels being stacked one on top of the other and side by side to form the complete wall with a complete front side;

(e) means connecting the panel reinforcing means to select tensile members in the region; and (f) cast colloidal means in the region filling the space between the back side of the panels and the front face, said cast colloidal means enveloping the connected reinforcing means and tensile means within the region, said cast colloidal means formed as separate layers one atop the other from the bottom to the top of the wall, each layer having a height no greater than the height of an integral number of panels, whereby the panels and the front face of the bulk form define the area for the cast colloidal means; said tensile means and gridforms being generally independently deformable relative to the panels and cast colloidal means, whereby consolidation of the bulk form will minimally stress or distort the panels and cast colloidal means.

2. The construction of claim 1 wherein the tensile members comprise elongate planar strips extending in parallel from the region through the bulk form.

3. The construction of claim 1 wherein the gridforms comprise wire mesh grids.

4. The construction of claim 1 wherein the gridforms are uniformly sized and define a series of coplanar first horizontal runs.

5. The construction of claim 4 wherein the first runs are uniformly spaced.

6. The construction of claim 1 wherein the tensile members are arrayed in a plurality of generally uniformly spaced horizontal planes.

7. The construction of claim 1 wherein the tensile members are arrayed in layers to define a plurality of generally horizontal planes in the bulk form and wherein the gridforms are connected to each layer.

8. The construction of claim 7 wherein the second runs of gridforms associated with adjacent layers overlap.

9. The construction of claim 1 wherein each gridform is an integral, L-shaped wire mesh unit.

10. The construction of claim 1 including a flexible fabric layer separating the front face of the gridforms from the region.

11. The construction of claim 1 wherein the panel reinforcing means comprises at least one plate like member, integrally attached at one end to the panel; and extending from the back side of the panel into the region in a cantilevered like fashion, to define the free end.

12. The construction of claim 1 wherein the means connecting the panel reinforcing means to select tensile members in the region comprises a member whose overall length adjusts to the proper dimension to connect the reinforcing means to select tensile members.

13. The construction of claim 11 wherein the means connecting the panel reinforcing means to select tensile members in the region comprises a member whose overall length adjusts to the proper dimension to provide a connection between the free end of the reinforcing member and the select tensile members.

14. The construction of claim 1 wherein the panel reinforcing means is a generally "U" shaped reinforcing bar extending from the back side of the panel into the region, wherein said reinforcing bar and the back side of the panel essentially form a loop.

15. The construction of claim 14 wherein the tensile members include openings positioned in the region and wherein the means connecting the panel reinforcing means to select tensile members includes bar members passing through the reinforcing bar loop and through select openings defined in the tensile members.

16. The construction of claim 14 wherein the openings of at least pairs of tensile members are aligned with a bar loop of a panel.

17. The construction of claim 1 including additional means for connecting the panels to each other directly.

18. The improvement of claim 1 wherein the means connecting the first run of a gridform to select tensile members comprises a generally "U" shaped connection member whose open end is connected by a bolt arrangement, the curvature in the "U" serving to loop around a part of the gridform and said member, to attach in part to select tensile member.

19. The improvement of claim 1 wherein the means connecting the panel reinforcing means to select tensile members comprises separate means within each separate layer of cast colloidal means.

20. The improvement of claim 1 wherein the cast colloidal means comprises concrete.

21. A method for building a retaining wall construction which includes unconsolidated, granular, compactable fill defining a bulk form and which provides for maintenance of the integrity of a facing for said construction as well as subsequent consolidation and strain of the retained bulk form covered by the facing without concomitant straining the facing, said method comprising the steps of:

(a) establishing a datum plane on which to build the construction;

(b) arranging a series of longitudinal tensile members along the datum plane of which at least a select one extends into a region beyond the front planar face of the bulk form;

(c) attaching a plurality of gridforms to select tensile members to provide the facing of the bulk form, with the select some of tensile members projecting therethrough into a region;

(d) placing a layer of unconsolidated, granular compactable fill on said plane to define a horizontal layer of bulk form;

(e) repeating the steps sequentially
(i) arranging tensile members,
(ii) attaching gridforms, and
(iii) placing fill
to thereby build a retaining wall construction comprising a series of layers of bulk form having tensile members at least in part frictionally engaging the fill;

(f) building an outside wall of a layer of preformed panel members spaced from the front face of the bulk form, whereby the space between such generally defining the area of the region;

(g) connecting the panel members to at least some of the tensile members extending into the region between the panel members and front face of the bulk form;

(h) filling the region with a reinforcing aggregate to define a first layer of aggregate; and (i) repeating the steps sequentially of
(i) building a layer of panel members on the previous layer,
(ii) connecting said panel members to select tensile members, and
(iii) filling the region with a layer of aggregate to thereby build the facing for the construction whereby the construction facing and bulk form remain connected in a sufficiently flexible manner to permit consolidation of the bulk form and minimum strain on the facing construction.

22. The method of claim 21 wherein the filling step comprises filling concrete as said aggregate.

23. An improved retaining wall construction comprising, in combination:

(a) a granular, compactable fill defining a three dimensional earthenwork bulk form having a generally planar front face extending upwardly from a datum plane;

(b) said earthenwork bulk form including a plurality of tensile members dispersed within the bulk form and extending in a generally horizontal straight line array through the bulk form and projecting beyond the front face into a region forward of the front face, sets of said tensile members defining generally spaced horizontal planes of elevation through the bulk form, said tensile members at least in part frictionally engaging the fill;

(c) said earthenwork bulk form also including a plurality of gridforms, each gridform including a first run extending from the front face of the bulk form partially into the bulk form along a horizontal plane of elevation and connected to at least some of the tensile members at that elevation, each gridform also including a second run along the generally planar front face joined to the horizontal first run; said second run extending upwardly from the first run; said second runs of said gridforms forming a pattern of grid material defining the planar front face of the bulk form;

(d) a plurality of separate preformed panels defining a complete wall surface generally parallel to and spaced outwardly from the planar front face of the bulk form, to define the region, each of said panels including a front side and a back side, and reinforcing means integral with each panel and extending into the region, said panels being stacked one on top of the other and side by side to form the complete wall with a complete front side;

(e) means connecting the panel reinforcing means to select tensile members in the region; wherein said means comprises a construction whose length may be adjusted to the dimension necessary for connecting said panel reinforcing means to select tensile members.

(f) cast colloidal means in the region filling the space between the back side of the panels and the front face, said cast colloidal means enveloping the connected reinforcing means and tensile means within the region, said cast colloidal means formed as separate layers one atop the other from the bottom to the top of the wall, each layer having a height no greater than the height of an integral number of panels, whereby the panels and the front face of the bulk form define the area for the cast colloidal means; said tensile means and gridforms being generally independently deformable relative to the panels and cast colloidal means, whereby consolidation of the bulk form will minimally stress or distort the panels and cast colloidal means.

24. A construction of claim 23 wherein the continued adjustment of the construction means connecting the panel reinforcing means to select tensile members in the region is achieved by a construction comprising at least one threaded connection.

25. An improved retaining wall construction comprising, in combination:

(a) a granular, compactable fill defining a three dimensional earthenwork bulk form having a generally planar front face extending upwardly from a datum plane;

(b) said earthenwork bulk form including a plurality of tensile members dispersed within the bulk form and extending in a generally horizontal straight line array through the bulk form and projecting beyond the front face into a region forward of the front face, sets of said tensile members defining generally spaced horizontal planes of elevation through the bulk form, said tensile members at least in part frictionally engaging the fill;

(c) said earthenwork bulk form also including a plurality of gridforms, each gridform including a first run extending from the front face of the bulk form partially into the bulk form along a horizontal plane of elevation and connected to at least some of the tensile members at that elevation, each gridform also including a second run along the generally planar front face joined to the horizontal first run; said second run extending upwardly from the first run; said second runs of said gridforms forming a pattern of grid material defining the planar front surface of the bulk form;

(d) a plurality of separate preformed panels defining a complete wall surface generally parallel to and spaced outwardly from the planar front face of the bulk form, to define the region, each of said panels including a front side and a back side, and reinforcing means integral with each panel and extending into the region, said panels being arranged side by side to form the complete wall with a complete front side;

(e) means connecting the panel reinforcing means to select tensile members in the region; and (f) cast colloidal means in the region filling the space between the back side of the panels and the front face, said cast colloidal means enveloping the connected reinforcing means and tensile means within the region, said cast colloidal means formed as separate layers one atop the other from the bottom to the top of the wall, each layer having a height no greater than the height of an integral number of panels, whereby the panels and the front face of the bulk form define the area for the cast colloidal means; said tensile means and gridforms being generally independently deformable relative to the panels and cast colloidal means whereby consolidation of the bulk form will minimally stress or distort the panels and cast colloidal means.

26. An improved retaining wall construction comprising, in combination:

(a) a granular, compactable fill defining a three dimensional earthenwork bulk form having a generally planar front face extending upwardly from a datum plane;

(b) said earthenwork bulk form including a plurality of tensile members dispersed within the bulk form and extending in a generally horizontal straight line array through the bulk form and projecting beyond the front face into a region forward of the front face, said tensile members at least in part frictionally engaging the fill;

(c) said earthenwork bulk form also including a gridform, said gridform connected to at least some of the tensile members, said gridform extending over and defining the generally planar front face;

(d) a plurality of separate preformed panels defining a complete wall surface generally parallel to and spaced outwardly from the planar front face of the bulk form, to define the region, each of said panels including a front side and a back side, and reinforcing means integral with each panel and extending into the region, said panels being stacked one on top of the other and side by side to form the complete wall with a complete front side;

(e) means connecting the panel reinforcing means to select tensile members in the region; and (f) cast colloidal means in the region filling the space between the back side of the panels and the front face, said cast colloidal means enveloping the connected reinforcing means and tensile means within the region, said cast colloidal means formed as separate layers one atop the other from the bottom to the top of the wall, each layer having a height no greater than the height of an integral number of panels, whereby the panels and the front face of the bulk form define the area for the cast colloidal means; said tensile means and gridforms being generally independently deformable relative to the panels and cast colloidal means, whereby consolidation of the bulk form will minimally stress or distort the panels and cast colloidal means.

27. An improved retaining wall construction comprising, in combination:

(a) a granular, compactable fill defining a three dimensional earthenwork bulk form having a generally planar front face extending upwardly from a datum plane;

(b) said earthenwork bulk form including a plurality of tensile members dispersed within the bulk form and extending in a generally horizontal straight line array through the bulk form and projecting beyond the front face into a region forward of the front face, sets of said tensile members defining generally spaced horizontal planes of elevation through the bulk form, said tensile members at least in part frictionally engaging the fill;

(c) said earthenwork bulk form also including a plurality of gridforms, each gridform including a first run extending from the front face of the bulk form partially into the bulk form along a horizontal plane of elevation and connected to at least some of the tensile members at that elevation, each gridform also including a second run along the generally planar front face joined to the horizontal first run; said second run extending upwardly from the first run; said second runs of said gridforms forming a pattern of grid material defining the planar front face of the bulk form;

(d) a plurality of separate preformed panels defining a complete wall surface generally parallel to and spaced outwardly from the planar front face of the bulk form, to define the region, each of said panels including a front side and a back side, and reinforcing means integral with each panel and extending into the region, said panels being stacked one on top of the other and side by side to form the complete wall with a complete front side;

(e) means connecting the panel reinforcing means to select tensile members in the region; and (f) aggregate means in the region filling the space between the back side of the panels and the front face, said aggregate means enveloping the connected reinforcing means and tensile means within the region, said aggregate means formed as separate layers one atop the other from the bottom to the top of the wall, each layer having a height no greater than the height of an integral number of panels, whereby the panels and the front face of the bulk form define the area for the aggregate means; said tensile means and gridforms being generally independently deformable relative to the panels and aggregate means whereby consolidation of the bulk form will minimally stress or distort the panels and aggregate means.

28. An improved retaining wall construction comprising, in combination:

(a) a granular, compactable fill defining a three dimensional earthenwork bulk form having a generally planar front face extending upwardly from a datum plane;

(b) said earthenwork bulk form including a plurality of tensile members dispersed within the bulk form and extending in a generally horizontal straight line array through the bulk form and projecting beyond the front face into a region forward of the front face, sets of said tensile members defining generally spaced horizontal planes of elevation through the bulk form, said tensile members at least in part frictionally engaging the fill;

(c) said earthenwork bulk form also including a plurality of gridforms, each gridform including a first run extending from the front face of the bulk form partially into the bulk form along a horizontal plane of elevation and connected to at least some of the tensile members at that elevation, each gridform also including a second run along the generally planar front face joined to the horizontal first run; said second run extending upwardly from the first run; said second runs of said gridforms forming an overlapping pattern of grid material defining the planar front face of the bulk form;

(d) a plurality of separate preformed panels defining a complete wall surface generally parallel to and spaced outwardly from the planar front face of the bulk form, to define the region, each of said panels including a front side and a back side, and reinforcing means integral with each panel and extending into the region, said panels being stacked one on top of the other and side by side to form the complete wall with a complete front side;

(e) means connecting the panel reinforcing means to select tensile members in the region; and (f) cast colloidal means in the region filling the space between the back side of the panels and the front face, said cast colloidal means enveloping the connected reinforcing means and tensile means within the region, said cast colloidal means formed as separate layers one atop the other from the bottom to the top of the wall, each layer having a height no greater than the height of an integral number of panels, whereby the panels and the front face of the bulk form define the area for the cast colloidal means; said tensile means and gridforms being generally independently deformable relative to the panels and cast colloidal means whereby consolidation of the bulk form will minimally stress or distort the panels and cast colloidal means.

29. In a retaining wall structure generally comprising a granular compactable fill defining a three dimensional earthen bulk form, having a generally planar front face; a plurality of tensile members embedded in said bulk form; and a plurality of gridform elements serving to cover the front face of the retained bulk form, an improved construction arrangement wherein:

(a) facing elements of the bulk form are generally "L" shaped, having one leg of the facing extending upwardly generally parallel to the front face of the bulk form and a second leg extending into the bulk form serving to provide a means for attaching the facing element to the tensile members within the bulk form, at a distance generally back from the front face of the bulk form, said second leg having a generally loop shaped end.

(b) means for connecting the second leg extension to select tensile members comprising a generally "U" shaped member whose ends are connected by a bolt arrangement, wherein the curvature of the "U" shaped member loops around the looped shaped end of the second leg extension, said connection member also being connected at least in part to the tensile members.

* * * * *